US006027110A

United States Patent [19]

Herrmann et al.

[11] Patent Number: 6,027,110

[45] Date of Patent: Feb. 22, 2000

[54] SHEET-FEEDING DEVICE

[75] Inventors: Herbert Herrmann, Obertshausen; Stefan Hartmann, Offenbach; Knut Wilde, Neu-Isenburg; Peter Eilitz, Offenbach, all of Germany

[73] Assignee: MAN Roland Druckmaschinen AG, Germany

[21] Appl. No.: 09/097,041

[22] Filed: Jun. 12, 1998

[30] Foreign Application Priority Data

Jun. 12, 1997 [DE] Germany ..... 197 24 733

[51] Int. Cl.[7] ..... B65H 5/08

[52] U.S. Cl. ..... 271/12; 271/10.07; 271/10.1; 271/10.15; 271/272

[58] Field of Search ..... 271/12, 10.07, 271/10.1, 10.15, 272, 273, 275, 198, 6, 4.06, 4.09, 7

[56] References Cited

U.S. PATENT DOCUMENTS

| | | | |
|---|---|---|---|
| 2,936,170 | 5/1960 | Herrick et al. | 271/12 |
| 3,126,199 | 3/1964 | Rosoff | 271/12 |
| 5,441,248 | 8/1995 | Kristola | 271/12 |

FOREIGN PATENT DOCUMENTS

| | | |
|---|---|---|
| 27 07 040 | 10/1977 | Germany . |
| 19537284 | 10/1996 | Germany . |

*Primary Examiner*—David H. Bollinger
*Attorney, Agent, or Firm*—Leydig, Voit & Mayer, Ltd.

[57] ABSTRACT

A sheet-feeding device for the cyclic feeding of separated sheets from a sheet stack of a sheet feeder to a sheet processing machine or an onward conveying device is provided. The sheet-feeding device includes one or more first conveying rollers of relatively small diameter which are rotatably arranged close to the leading edge of the sheet stack of the sheet feeder and around which one or more endless drive tapes are guided, the latter starting from the first conveying roller, extending approximately in the conveying direction and wrapping around a second conveying roll that is arranged at a distance from the first conveying roller. The device also includes an upper conveying roller mounted above the first conveying roller for rotation about an axis parallel to the axis of the first conveying roller. The upper conveying roller and the first conveying roller are arranged such that the leading edge of the respective sheets fed from the sheet feeder are seized between the upper conveying roller and the drive tape and transported onwards through the rotation of the first and second conveying rollers and the upper conveying roller.

14 Claims, 2 Drawing Sheets

SHEET-FEEDING DEVICE

FIELD OF THE INVENTION

This invention generally relates to printing machines and, more particularly, to a sheet-feeding device for the cyclic feeding of separated sheets from a sheet feeder to a sheet processing machine or an onward conveying device.

BACKGROUND OF THE INVENTION

Sheet-feeding devices for the cyclic feeding of separated sheets from a sheet feeder to a sheet processing machine or an onward conveying device, such as a tape table, generally include a pair of conveying rollers or draw-off rollers arranged one above another downstream of the sheet stack in the conveying direction. The leading edge of the sheets are fed by transport suckers to the region between the pair of conveying rollers. The conveying rollers or draw-off rollers seize the sheets between them and convey the sheets onwards as a result of their rotation.

Sheet-feeding devices of this type must utilize relatively large diameter conveying rolls and/or draw-off rollers in order to be able to ensure reliable and distortion-free seizing and transporting of the sheets. The large diameter of the conveying or draw-off rollers, however, results in a corresponding long conveying path through the transport suckers, between the sheet stack and the point at which the respectively conveyed sheet can be seized between the conveying rolls or draw-off rollers.

This long conveying path also impacts the elements feeding the sheet to the conveying rolls or draw-off rollers, which in this case comprise what is referred to as a suction head. At the highest possible desired cycle speeds, the movement of the elements of the suction head that feed the sheets is also very rapid, this results in high accelerations and, for reversing the motion for example in the case of the dragging suckers, decelerations of the elements. Because of this rapid movement, however, the loading and the wear of the elements of the suction head and the susceptibility of the elements to defects are also quite high. Additionally, if the sheet feeding device includes a sheet flap between the conveying rolls or draw-off rollers and the sheet feeder, as is generally the case, then the distance between the conveying rolls or draw-off rollers and the sheet stack, and hence the conveying path that has to be overcome by the elements of the sheet feeder that feed the sheet, is even longer. As will be appreciated, this further increases the loading of these elements.

OBJECTS AND SUMMARY OF THE INVENTION

Accordingly, in view of the foregoing, it is an object of the invention to provide a sheet-feeding device which reduces the loading of the elements feeding the sheets from the sheet feeder to the rollers while significantly improving sheet handling.

The present invention provides these and other objects by replacing the lower roller of a conventional sheet feeding device with one or more first conveying rollers of relatively small diameter which are rotatably arranged close to the leading edge of the sheet stack of the sheet feeder and around which one or more endless drive tapes are guided, the latter starting from the first conveying roller, extending approximately in the conveying direction and wrapping around a second conveying roll that is arranged at a distance from the first conveying roller. Hence, the vertex region of the first conveying roller and of the upper conveying roller that seize the sheets that are fed by the sheet feeder is positioned close to the leading edge of the upper sheet carried by the sheet feeder. As a result, the path between the sheet stack and the point at which the sheets are seized between the first conveying roller and the upper conveying roller is quite short. This shorter path leads to reduced loading of the elements which transfer the sheets from the sheet stack to the conveying rollers and more reliable handling of the sheets.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
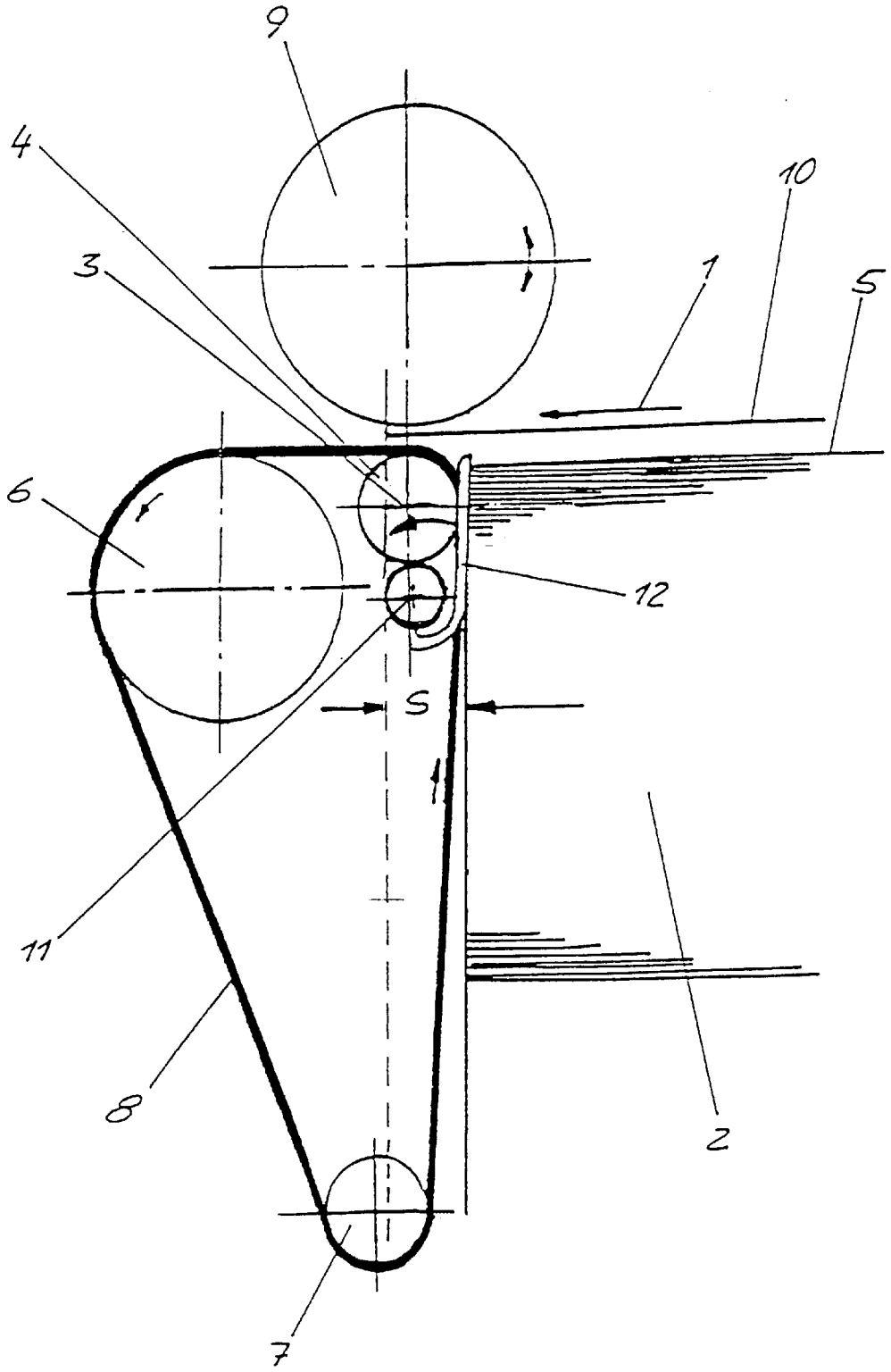
FIG. 1 is a schematic side view of an illustrative sheet-feeding device constructed in accordance with the present invention.

Referring now more particularly to FIG. 1, there is shown a illustrative sheet-feeding device which includes a plurality of conveying rollers in accordance with the present invention. The sheet-feeding device is arranged immediately downstream of a sheet stack 2 in the conveying direction 1. The sheet stack, in this instance is supported in a sheet feeder (not shown).

Figure 2:
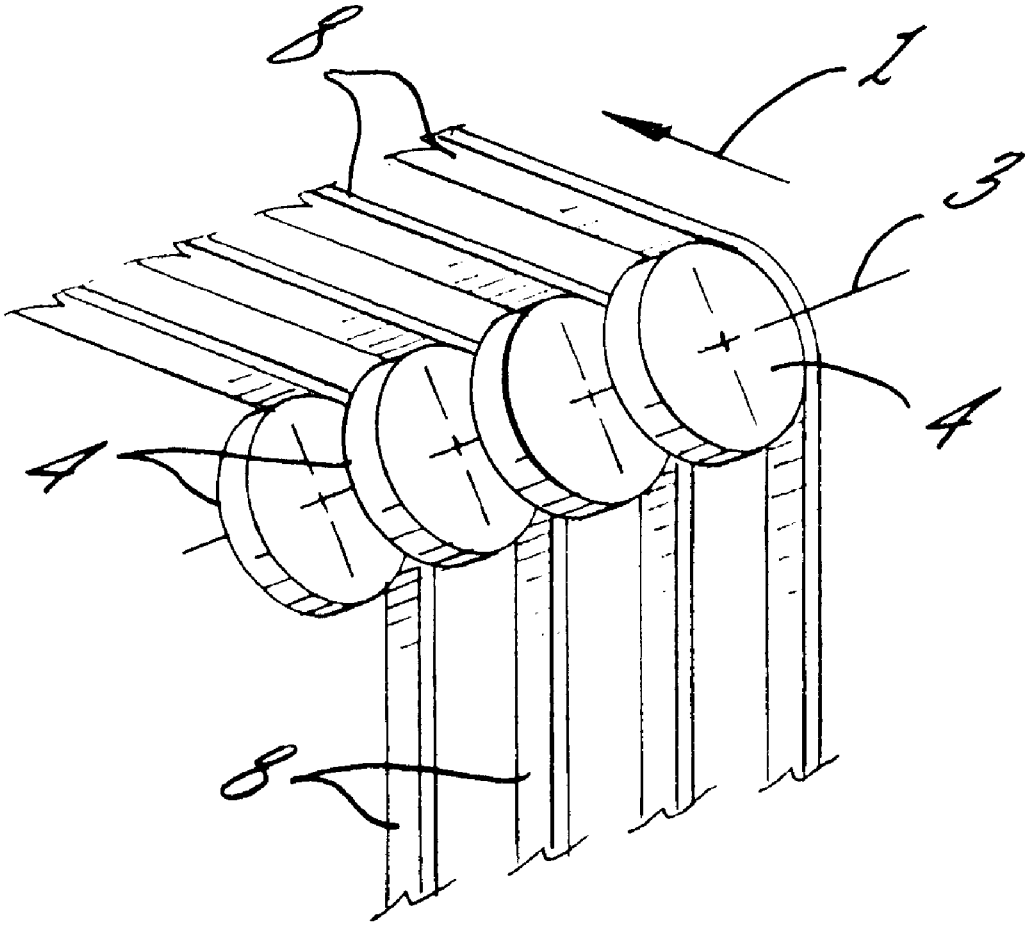
FIG. 2 is a partially diagrammatic perspective of an alternative embodiment of the sheet-feeding device according to the invention.

In accordance with an important aspect of the present invention, the sheet-feeding device is configured such that the sheet conveying path between the sheet stack and the conveying rollers of the sheet-feeding device is relatively short. This results in reduced loading of the elements feeding the sheets from the sheet stack to the conveying rollers and significantly improves the reliability of the sheet handling. To this end, in the illustrated embodiment, the sheet-feeding device has a first conveying roller 4 of relatively small diameter which is mounted so as to be freely rotatable about an axis 3 immediately downstream of the sheet stack 2 in the conveying direction 1. As shown in FIG. 1, the vertex of the conveying roller 4 is located above the sheet stack 2, which is held by the sheet feeder with its uppermost sheet 5 always immediately below the vertex height of the conveying roller 4. A second conveying roll 6 of considerably greater diameter than the first conveying roller 4 is arranged at a distance from the conveying roller 4 in the conveying direction 1, and with its vertex at the same height as the vertex of the first conveying roller 4. In the illustrated embodiment, the first conveying roller 4 has a diameter that is less than one-half the diameter of the second conveying roller 6. The second conveying roll 6 is arranged such that it can be rotated by a drive device (not shown). Those skilled in the art will appreciate that the first conveying roller 4 may comprise a plurality of rollers which in one preferred embodiment are rotatably mounted about a common axis, as depicted in FIG. 2.

In carrying out the invention, for interconnecting the first conveying roller 4 and the second conveying roll 6 an endless drive tape 8 is provided which extends around the first conveying roller 4 and the second conveying roll 6. Through the rotary drive of the conveying roll 6, the drive tape 8 is driven in such a manner that it moves in the conveying direction 1 in the region between the first conveying roller 4 and the second conveying roll 6. Those skilled in the art will readily appreciate that more than one drive tape may be provided around the first conveying roller 4 and the second conveying roll and that if more than one first conveying rollers are provided a drive tape should extend around each first conveying roller, as depicted in FIG. 2.

For ensuring that the drive tape 8 is kept at the optimal tension, the drive tape can be guided over a tensioning roller 7. In the illustrated embodiment, the tensioning roller 7 is mounted so as to be freely rotatable at a relatively considerable distance below the first conveying roller 4 such that the drive tape 8 extends around a substantially triangular path.

For cooperating with the first conveying roller 4 and the second conveying roll 6 to enable the seizure of the sheets, an upper conveying roller, which in this case is configured as a cyclic action roller 9, is arranged vertically above the center of the conveying roller 4. The cyclic action roller 9 is mounted so as to be freely rotatable and is driven at the working cycle of the sheet-feeding device such that it can be lowered vertically onto and lifted off the conveying roller 4. As shown in FIG. 1, the cyclic action roller 9 has a significantly greater diameter than the conveying roller 4. The illustrated first conveying roller 4 again has a diameter less than one-half the diameter of the upper conveying roller 9. Moreover, a portion of the circumferential surface of the cyclic action roller 9 projects over the sheet stack 2 counter to the conveying direction into a otherwise open space above the leading region of the sheet stack. Since the conveyed sheet is pressed onto the drive tape by the cyclic action roller 9, the sheet is seized and transported onwards reliably and without distortion. The seizing of the sheet can be made even more reliable if the cyclic action roller 9 has a significantly larger diameter than the conveying rollers. Since in the illustrated embodiment the third conveying roller is configured as a cyclic action roller, an imbricated sheet stream can be produced simply by lowering and raising the cyclic action roller at the working cycle of the sheet-feeding device.

For lifting a sheet 10 from the sheet stack and subsequently moving the sheet 10 in the conveying direction to the cyclic action roller 9 and the first conveying roller 4, the sheet feeder has a suction head having lifting suckers and dragging suckers which move the sheet 10 in the conveying direction 1 over a path "S". In the process, the sheet 10 is inserted with its leading edge between the cyclic action roller 9 and the conveying roller 4 around which the drive tape 8 extends. With the cyclic action roller 9 lowered, the sheet is seized by the cyclic action roller 9 and drive tape 8 and is transported onwards in the conveying direction 1 to a sheet processing device or an another onward conveying device, for example a feeder table. As will be appreciated, if a plurality of first conveying rollers are provided, the distance between the distance between the inner pair of first conveying rollers can be selected so as to be less than the width of the smallest sheet to be processed by the sheet-feeding device in order to ensure that there will be no need to readjust or rebuild the sheet-feeding device when the size of the sheets being processed is changed.

In order to facilitate the transfer of the sheets from the sheet stack to the point at which the sheet is seized by the cyclic action roller 9 and the drive tape 8, a sheet flap 12 is provided. The sheet flap 12 is pivotally mounted beside the first conveying roller 4 and can be driven so as to pivot about a pivot axis 11 at the working cycle of the sheet-feeding device between a position in which it is oriented vertically upwards and rests on the leading edge of the sheet stack 2 and a position in which it is inclined in the conveying direction 1. During the seizing of the sheet 10 and the lifting of the sheet by the lifting suckers, the sheet flap 12 is arranged in the vertical position so as to prevent the following sheets of the sheet stack 2 from being displaced in the conveying direction 1. During the feeding movement of the lifted sheet 10 between the drive tape 8 and cyclic action roller 9, the sheet flap 12 pivots by a specific amount in the conveying direction 1 and forms an insertion incline along which the leading edge of the sheet 10 can slide in order to be seized by the drive tape 8 and the cyclic action roller 9.

From the foregoing it can be seen that the correct seizing and conveying of the sheets is ensured by utilizing two or more conveying rollers which are arranged at a distance from one another and a drive tape which is guided around each of the conveying rollers. Specifically, as a result of the small diameter of the conveying roller 4 and its arrangement close to the sheet stack 2, the path "S" between the sheet stack and the point at which the sheet is seized between the first conveying roller and the upper conveying roller is very short, with the result being that the dragging suckers can move at a relatively low speed, even when the sheet-feeding device is operating at a high cyclic frequency. The shorter conveying path which must be overcome leads not only to lower loading on the elements of the feeder table that feed the sheet but also primarily facilitates a noticeably more reliable handling of the conveyed sheets with regard to increased cycle speed and lower printed material grammages. The lower loading of the feeding elements and the improved handling of the sheets also enables an increase in the cycle frequency, and thus, an increase in the capacity of the sheet feeder. Moreover, the lower loading and more reliable handling, in conjunction with considerably reduced blowing under the sheet that is lifted from the sheet stack by the feeding elements, leads to a considerably reduced energy requirement for preparing the blast air, in addition to the saving in energy for the elements that feed the sheet.

What is claimed is:

1. A sheet-feeding device for the cyclic feeding of separated sheets in a conveying direction from a sheet stack of a sheet feeder to a sheet processing machine or an onward conveying device, the sheet-feeding device comprising:

a first conveying roller mounted downstream of the sheet stack in the conveying direction for rotation about an axis that extends transversely with respect to the conveying direction, a second conveying roller rotatably mounted in spaced relation from the first conveying roller, an endless drive tape extending around the circumferential surface of the first and second conveying rollers, an upper conveying roller mounted above the first conveying roller for rotation about an axis parallel to the axis of the first conveying roller, said upper conveying roller and the first conveying roller being arranged such that the leading edge of the respective sheets fed from the sheet feeder can be seized between the upper conveying roller and the drive tape and transported onwards through the rotation of the first and second conveying rollers and the upper conveying roller, and said first conveying roller being smaller in diameter than said second and upper conveying rollers and being disposed in close proximity to the leading edge of the sheet stack.

2. The sheet-feeding device as in claim 1, wherein the drive tape extends around a third roller that is positioned below the first and second conveying rollers such that the drive tape extends over an approximately triangular course.

3. The sheet-feeding device as in claim 2, wherein the third roller function as a tensioning roller.

4. The sheet-feeding device as in claim 3, wherein the upper conveying roller is free rotatable.

5. A sheet-feeding device for the cyclic feeding of separated sheets in a conveying direction from a sheet stack of a sheet feeder to a sheet processing machine or an onward conveying device, the sheet-feeding device comprising:

a plurality of first conveying rollers coaxially arranged downstream of the sheet stack in the conveying direction for rotation about an axis that extends transversely with respect to the conveying direction, a second conveying roller rotatably mounted in spaced relation from the first conveying rollers, said first conveying rollers being smaller in diameter than said second conveying roller and being mounted in close proximity to the leading edge of the sheet stack, an endless drive tape extending around the circumferential surface of said second conveying roller and each of said first conveying rollers, and an upper conveying roller mounted above the first conveying roller for rotation about an axis parallel to the axis of the first conveying roller, said upper conveying roller and the first conveying rollers being arranged such that the leading edge of the respective sheets fed from the sheet feeder can be seized between the upper conveying roller and the drive tape and transported onwards through the rotation of the first and second conveying rollers and the upper conveying roller.

6. The sheet-feeding device as in claim 5, wherein the distance between an inner pair of said first conveying rollers is less than the smallest width of the sheets to be processed by the sheet feeding device.

7. The sheet feeding device as in claim 5, wherein the plurality of first conveying rollers are rotatably mounted in coaxial relation.

8. The sheet feeding device as in claim 5, wherein a sheet flap is arranged besides the first conveying rollers, the sheet flap being pivotable about a pivot axis at the cycle of the sheet-feeding device, between a position in which it is oriented vertically upwards and rests on the leading edge of the sheet stack and a position in which it is inclined in the conveying direction.

9. A sheet-feeding device for the cyclic feeding of separated sheets in a conveying direction from a sheet stack of a sheet feeder to a sheet processing machine or an onward conveying device, the sheet-feeding device comprising:

a first conveying roller arranged downstream of the sheet stack in the conveying direction for rotation about an axis that extends transversely with respect to the conveying direction, a second conveying roller rotatably mounted in spaced relation from the first conveying roller, an endless drive tape extending around the circumferential surface of the first and second conveying rollers, an upper conveying roller above the first conveying roller for rotation about an axis parallel to the axis of the first conveying roller, said first conveying roller being smaller in diameter than said upper conveying roller and being disposed in close proximity to the leading edge of the sheet stack, and said upper conveying roller being mounted for movement between a raised position removed from said sheets, drive tape and first conveying roller and a lowered position such that the leading edge of a respective sheet from the sheet feeder can be seized between the upper conveying roller and the drive tape and transported onwards on as an incident to rotation of the first and second conveying rollers and the upper conveying roller.

10. A sheet-feeding device for the cyclic feeding of separated sheets in a conveying direction from a sheet stack of a sheet feeder to a sheet processing machine or an onward conveying device, the sheet-feeding device comprising:

a first conveying roller mounted downstream of the sheet stack in the conveying direction for rotation about an axis that extends transversely with respect to the conveying direction, a second conveying roller rotatably mounted in spaced relation from the first conveying roller, an endless drive tape extending around the circumferential surface of the first and second conveying rollers, an upper conveying roller mounted above the first conveying roller for rotation about an axis parallel to the axis of the first conveying roller, said upper conveying roller and the first conveying roller being arranged such that the leading edge of the respective sheets fed from the sheet feeder can be seized between the upper conveying roller and the drive tape and transported onwards through the rotation of the first and second conveying rollers and the upper conveying roller, and said first conveying roller having a diameter less than one-half the diameter of one of said second conveying roller and said upper conveying roller and being disposed in close proximity to the leading edge of the sheet stack.

11. The sheet-feeding device as in claim 10 in which said first conveying roller has a diameter less than one-half the diameter of each of said second and upper conveying rollers.

12. The sheet-feeding device as in claim 10 in which said first conveying roller has a diameter less than one-half the diameter of said upper conveying roller.

13. The sheet-feeding device as in claim 10 in which said first conveying roller has a diameter less than one-half the diameter of said second conveying roller.

14. The sheet-feeding device as in claim 10 in which said first conveyor roller has a diameter less than one-half the diameters of each of said second and upper conveying rollers.

* * * * *